US008499578B2

(12) United States Patent
Ferragut, II et al.

(10) Patent No.: US 8,499,578 B2
(45) Date of Patent: Aug. 6, 2013

(54) WATER PRODUCT DISPENSING SYSTEM

(75) Inventors: Nelson J. Ferragut, II, Williamsburg, IA (US); James H. Jenkins, Jr., Amana, IA (US); Craig Lear, Coralville, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 1730 days.

(21) Appl. No.: 11/505,893

(22) Filed: Aug. 18, 2006

(65) Prior Publication Data

US 2008/0041073 A1 Feb. 21, 2008

(51) Int. Cl.
*B67D 7/76* (2010.01)
*F25D 3/00* (2006.01)

(52) U.S. Cl.
USPC ..... 62/389; 222/146.6; 62/129

(58) Field of Classification Search
USPC ..... 62/121, 129, 389; 222/146.6
See application file for complete search history.

(56) References Cited

U.S. PATENT DOCUMENTS

| | | | | |
|---|---|---|---|---|
| 1,922,995 | A * | 8/1933 | Wallach | 312/324 |
| 2,982,114 | A * | 5/1961 | Cobb et al. | 62/338 |
| 4,490,986 | A | 1/1985 | Paddock | |
| 5,546,100 | A * | 8/1996 | Saegusa | 345/51 |
| 5,918,773 | A * | 7/1999 | Donovan et al. | 222/146.6 |
| 6,101,452 | A * | 8/2000 | Krall et al. | 702/55 |
| 6,104,674 | A * | 8/2000 | Emoff et al. | 368/109 |
| 6,355,177 | B2 | 3/2002 | Senner et al. | |
| 6,375,834 | B1 | 4/2002 | Guess et al. | |
| 6,546,741 | B2 | 4/2003 | Yun et al. | |
| 6,613,236 | B1 | 9/2003 | Guess et al. | |
| 6,708,506 | B2 | 3/2004 | Lee | |
| 6,715,302 | B2 | 4/2004 | Ferragut, II | |
| 6,882,280 | B2 | 4/2005 | Ferragut, II | |
| 7,201,005 | B2 * | 4/2007 | Voglewede et al. | 62/126 |
| 2002/0145009 | A1 * | 10/2002 | Busick et al. | 222/146.6 |
| 2002/0189983 | A1 | 12/2002 | Guess et al. | |
| 2002/0195467 | A1 * | 12/2002 | Meder et al. | 222/146.6 |
| 2003/0010043 | A1 * | 1/2003 | Ferragut, II | 62/126 |
| 2003/0056526 | A1 * | 3/2003 | Holmes et al. | 62/156 |

FOREIGN PATENT DOCUMENTS

| | | |
|---|---|---|
| EP | 1039441 | 9/2000 |
| JP | 2005016871 | 1/2005 |

* cited by examiner

*Primary Examiner* — Ljiljana Ciric
*Assistant Examiner* — Alexis Cox
(74) *Attorney, Agent, or Firm* — Kirk W. Goodwin; Diederiks & Whitelaw PLC

(57) ABSTRACT

A water product dispensing system includes a dispenser mounted for selectively releasing a water product, a display provided on the dispenser and a sensor operatively coupled to the dispenser. The dispensing system also includes a sensor for determining a fault condition. In the event that a fault condition exists, the fault condition is presented upon the display only upon operation of the dispensing system. The water product dispensing system also includes a water filter, with the fault condition indicating a need to replace the water filter.

19 Claims, 3 Drawing Sheets

WATER PRODUCT DISPENSING SYSTEM

BACKGROUND OF THE INVENTION

1. Field of the Invention

The present invention pertains to the art of refrigerators and, more particularly, to a water product dispensing system for a refrigerator that displays a fault condition associated with the water product only upon activation of the dispensing system.

2. Discussion of the Prior Art

Dispensing systems have been incorporated into various household appliances, particularly refrigerators, for some time. The dispensing systems are designed to release water and/or ice, depending upon a particular model of refrigerator. Over time, dispensing systems were provided with water filters designed to remove impurities from the water prior to a dispensing operation. Often times, the water filter was also connected to an ice maker in order to filter the water prior to being formed into ice cubes.

While water filters provide a nice benefit, over time, the efficacy of the water filter is lowered as more and more impurities are removed from the water. Thus, in order to maintain a proper level of filtration, the water filter must be periodically replaced. However, how often the water filter requires replacement will vary from consumer to consumer. That is, consumers that use the dispensing system more frequently, or use a lot of ice, will find themselves replacing water filters more often than consumers who utilize the dispensing system less often.

Many dispensing systems include some form of warning that provides an indication to the consumer that the water filter is, or soon will be, in need of replacement. Early dispensing systems simply provided a decal, having a date indicator of some form, that informed the consumer of an approximate replacement date. Unfortunately the decal could not take into account various factors regarding a need for filter replacement such as, for example, actual use of the filter. Thus, manufactures provided a visual warning indicating the need to replace the filter. The visual warning was typically tied to a flow sensor or timer that determined an amount of usage of the dispensing system.

While effective at providing a more accurate warning of an impending need to replace a water filter, the visual alarm is not well suited for use in today's more modern dispensing systems. Modern dispensing systems typically include an LED or LCD display that presents the consumer with a variety of options. When incorporated into a refrigerator, the display will enable the consumer to control lighting, dispensing water or ice, and/or whether to dispense crushed or cubed ice. In addition, the display will provide a signal to the consumer that it is time to replace the water filter. However, providing a continuous signal on an LED or LCD display can often lead to "burn-in." That is, the signal will remain on the display, in phantom, even when the signal is not active. Thus, presenting a continuous signal on the display, will reduce an overall service life of the display. In addition, LED or LCD displays typically employ a backlight to enhance viewability of any displayed text. Providing a continuous backlight to the display will also reduce service life.

Based on the above, there exists a need in the art for an alarm display for a water dispensing system. More specifically, there exists a need for a display that can present a signal indicating an alarm condition to a consumer only during times when the consumer is likely to view the signal, and not during times when it is unlikely that the consumer will view the signal.

SUMMARY OF THE INVENTION

The present invention is directed to a refrigerator having a water product dispensing system incorporating a dispenser. The dispenser includes a display and is mounted to a door of the refrigerator. The dispensing system also includes a sensor operatively coupled to the dispenser for determining a fault condition. In the event that a fault condition exists, the fault condition is presented on the display only upon operation of the dispensing system.

In accordance with a preferred form of the invention, the water product dispensing system includes a water delivery system having a water valve. The water valve is selectively moved from a closed position, preventing release of the water product to an open position, allowing the water product to flow towards the dispenser. In addition, the water delivery system also includes a water filter operatively connected to the water valve. In accordance with a preferred form of the invention, the fault condition indicates a need to replace the water filter.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
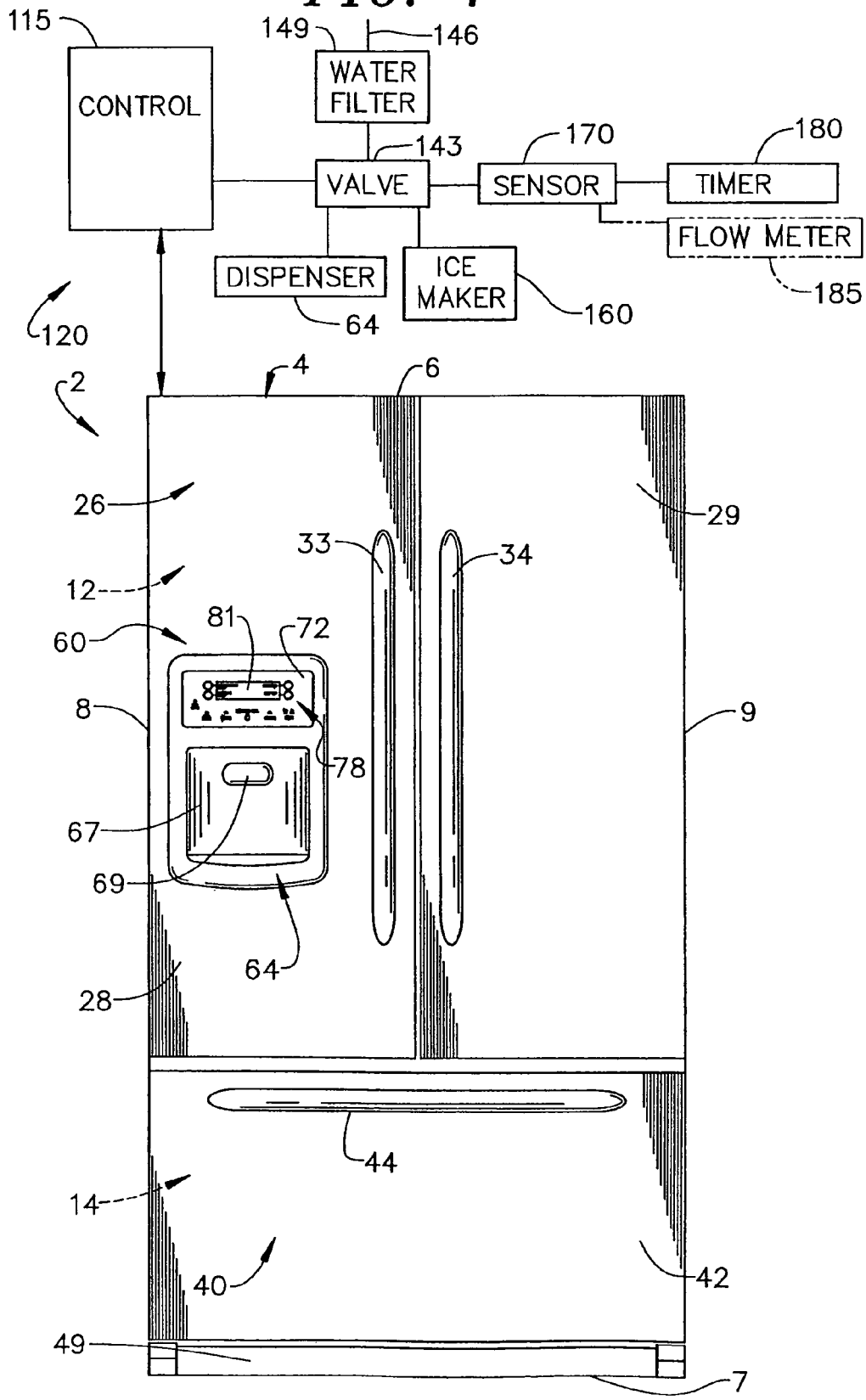
FIG. 1 is a front, elevational view of a refrigerator incorporating a water dispensing system constructed in accordance with the present invention.

With initial reference to FIG. 1, a refrigerator, generally indicated at 2, is shown to include a cabinet shell 4 having a top wall 6, a bottom wall 7 and opposing side walls 8 and 9. Refrigerator 2 includes a first or fresh food compartment 12 and a second or freezer compartment 14. In the embodiment shown, freezer compartment 14 is positioned below fresh food compartment 12 so as to establish a bottom mount configuration for refrigerator 2. As also shown, refrigerator 2 includes an upper door assembly 26 having a first door member 28 and a second door member 29 that actually define French-style doors employed in connection with first or fresh food compartment 12. Each door member 28, 29 includes a corresponding handle 33, 34 that enables a consumer to selectively access fresh food compartment 12. That is, in accordance with the embodiment shown, a consumer can open one, the other or both door members 28 and 29 to retrieve food or other articles stored therein.

Freezer compartment 14 is provided with a door assembly 40 including a door member 42 provided with a handle 44. Door assembly 40 is selectively shifted outward from cabinet shell 4 to provide access to shelves (not shown) suspended from door member 42. That is, in a manner known in the art, door member 42 serves as a support for various shiftable shelves for supporting objects within freezer compartment 14. Finally, in a manner also known in the art, refrigerator 2 is shown to include a kick plate 49 positioned below freezer compartment 14.

In accordance with the invention, refrigerator 2 includes a water product dispensing system 60 having a dispenser 64 for delivering a water product, for example, water and/or ice, to a consumer without requiring accessing fresh food compartment 12 or freezer compartment 14. Actually, dispenser 64 is associated with fresh food compartment 12, yet still enables dispensing of ice cubes. In any case, dispenser 64 includes a dispensing portion 67, having an activating mechanism 69 and a control portion 72 having associated therewith a control panel 75 that is provided with a plurality of control elements 78 and a display 81.

Figure 2:
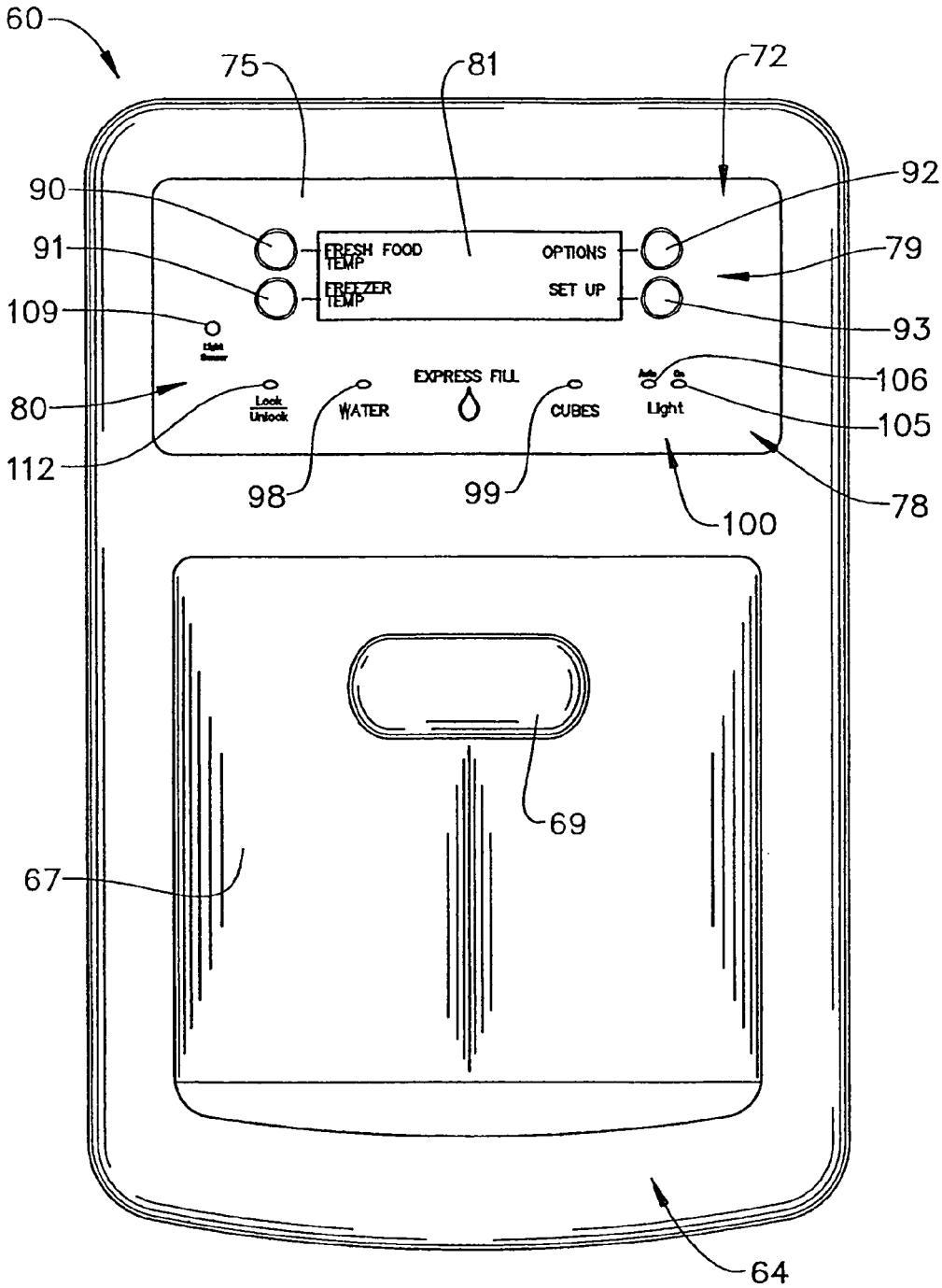
FIG. 2 is a water product dispenser, having a display, mounted to a door of the refrigerator of FIG. 1.

As best shown in FIG. 2, plurality of control elements 78 include a first plurality of ATM-style buttons 79 arranged along either side of display 81. More specifically, first plurality of control buttons 79 includes a fresh food temperature selection button 90, a freezer temperature selection button 91, an options button 92 and a set-up button 93. Buttons 90-93 enable a consumer to access and alter various settings associated with refrigerator 2 including, for example, setting a fresh food compartment temperature, setting a freezer compartment temperature, as well as various other features known in the art. Once a particular one of the plurality of control buttons 79 is activated, display 81 switches to a screen (not shown) associated with the particular one of the plurality of control buttons 79. At this point, the particular function of the plurality of control buttons 79 changes to suit the particular screen.

In addition to the first plurality of control elements 79, control panel 75 includes a second plurality of control elements 80 that are associated with the operation of dispenser 64. More specifically, control elements 80 include a pair of water product selection buttons 98 and 99 for selecting between water dispensing and ice dispensing respectively. In addition, second plurality of control elements 80 include a light control portion 100 that selectively activates a light (not shown) associated with dispenser 64 and an associated indicator light 105. Light control portion 100 enables a consumer to activate the light (not shown) associated with dispenser 64 continuously or automatically. When in automatic mode, a light sensor 109 activates the light (not shown) associated with dispenser 64 based upon available ambient light conditions. Finally, second plurality of control buttons 80 includes a lock button 112 that, when activated, prevents operation of buttons 79 and 80. That is, when activated, lock button 112 ensures that, for example, a small child does not inadvertently play with dispenser 64, such as changing various settings for refrigerator 2.

In further accordance with the invention, refrigerator 2 includes a controller 115 that, upon sensing a demand for a water product through, for example, activation mechanism 69, activates a water delivery system 120 that includes a valve 143 which controls a flow of water from a water feed line 146, through a water filter 149, to dispenser 64. Valve 143 also enables water to flow to an icemaker 160 upon sensing a demand for ice. More specifically, upon activation of activation mechanism 69, controller 115 opens valve 143 allowing water to flow through water filter 149 to dispenser 64. In a similar manner, an icemaker control (not shown) activates valve 143 to deliver water to icemaker 160. The actual operation and plumbing of the dispensing system does not form part of the present invention and thus, will not be discussed more fully herein. A more detailed description of the water system can be found in commonly assigned U.S. Pat. Nos. 6,120,685 and 6,303,031 which are incorporated herein by reference. In any event, valve 143 is operatively connected to a sensor 170 which, in accordance with one aspect of the invention, includes a timer 180 that senses an on time of valve 143 or, in accordance with another aspect of the invention, includes a flow meter 185 that can determine a flow rate through valve 143. In either case, sensor 170 determines an amount of water passing through water filter 149 in order to predict an operational life of water filter 149.

Figure 3:
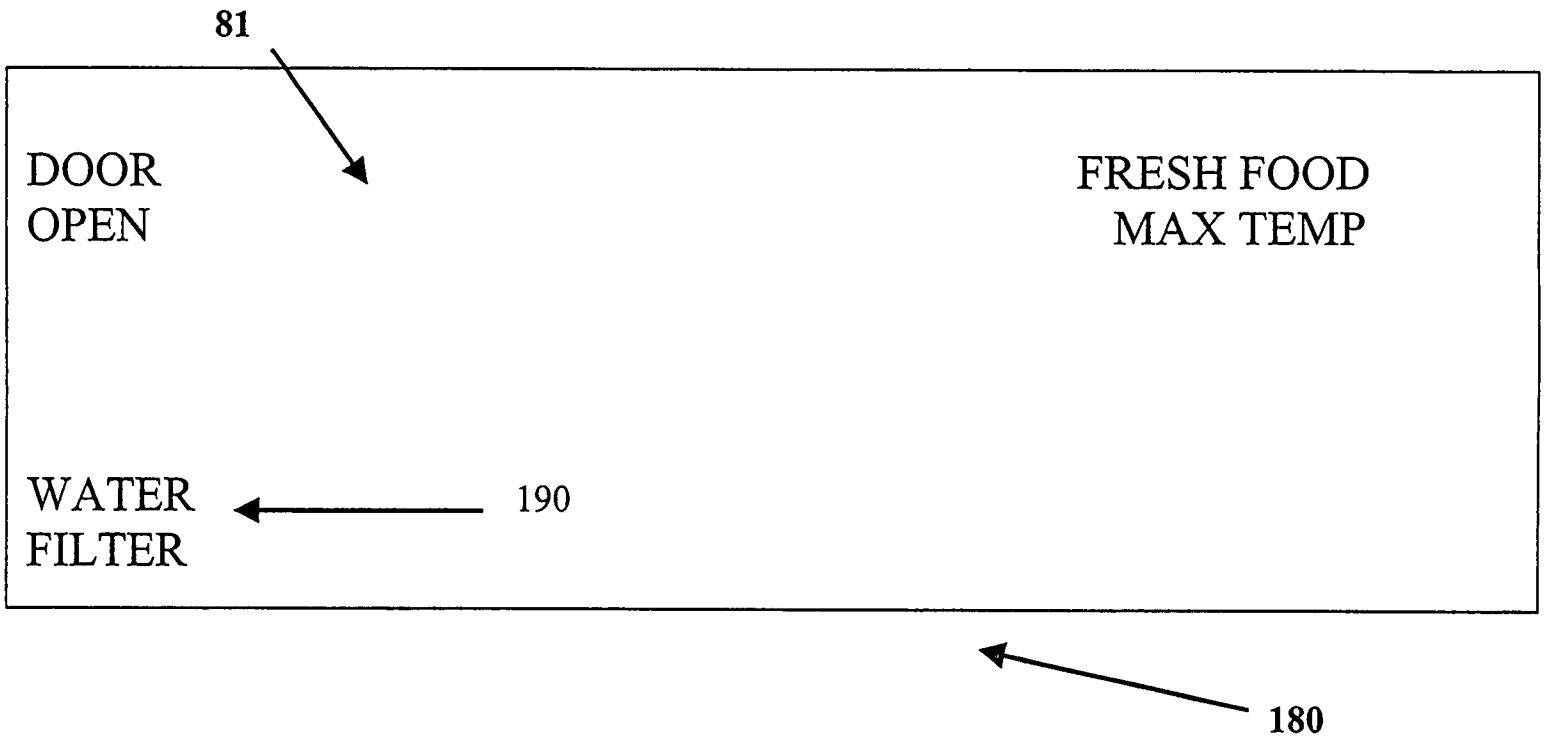
FIG. 3 is an alarm screen presented on the display of FIG. 2.

Over time, the ability of water filter 149 to remove impurities from the water will degrade. Thus, to ensure continued proper filtration, water filter 149 must be replaced. Accordingly, sensor 170 provides controller 115 with a signal indicating an amount of use of water filter 149. Controller 115 then determines whether water filter 149 is approaching an end of a useful service life and thus, will soon require replacement. When controller 115 determines that water filter 149 should be replaced, an alarm screen 180 (see FIG. 3) is presented on display 81, and an indication of a fault condition 190 is presented to the consumer. Fault condition 190 is preferably presented in an alpha format to inform the consumer of the exact nature of the fault, e.g., water filter 149 requires replacement.

In accordance with the most preferred form of the invention, controller 115 presents fault condition 190 on alarm screen 180 only upon activation of water product delivery system 120. Preferably, fault condition 190 remains on alarm screen 180, and alarm screen 180 remains active on display 81, for a period of approximately 30 seconds following deactivation of water delivery system 120 or completion of a dispensing operation. For example, controller 115 will activate alarm screen 180 and present fault condition 190 upon display 81 upon activation of activating mechanism 69, triggering activation of valve 143, to release water through dispenser 64. In addition to presenting fault condition 190, alarm screen 180 could present other alarm conditions such as door open or temperature alarms. Finally, when presenting fault condition 190, a backlight associated with display 81 can be activated. For further emphasis, fault condition 190 flashes on alarm screen 180. In this manner, fault condition 190 is presented to the consumer only when the consumer is utilizing dispenser 64.

Although described with reference to a preferred embodiment of the invention, it should be readily understood that various changes and/or modifications can be made to the invention without departing from the spirit thereof. For instance, while shown in connection with a French-style door refrigerator, the present invention could also be employed in other models such as top mount, side-by-side models and the like. In addition, it should be understood that the fault condition need not be limited to indicating a need for replacement of a water filter but could also present additional information regarding the dispensing system to the consumer such as, for example, a faulty valve, faulty sensor and icemaker fault conditions. Finally, the fault condition could also be presented on the display upon dispensing ice from the dispenser. In general, the invention is only intended to be limited by the scope of the following claims.

We claim:

1. A refrigerator comprising:

a cabinet shell;

a liner arranged within the cabinet shell and defining a refrigerated compartment;

a door pivotally mounted relative to the cabinet shell for selectively closing the refrigerated compartment; and a water product dispensing system including:

a water delivery system including a valve that controls a flow of water in the refrigerator;

a dispenser mounted in the door for selectively releasing a water product;

a display provided on the dispenser, wherein the display includes an alarm screen; and a sensor operatively coupled to the dispenser and the water delivery system, said sensor determining a fault condition and presenting the fault condition on the display upon sensing demand for a water product, wherein the fault condition is displayed only during a period of time when a consumer activating the water delivery system is likely to view the fault condition on the display, said fault condition being presented on the alarm screen, wherein the alarm screen flashes the fault condition.

2. The refrigerator according to claim 1, wherein the display is constituted by an LCD display provided with a backlight, said backlight being automatically activated upon operation of the water product dispensing system.

3. The refrigerator according to claim 1, wherein the fault condition is presented in an alpha format.

4. The refrigerator according to claim 1, wherein the water delivery system includes a water filter operatively connected to the valve, said fault condition being associated with water flowing through the water filter.

5. The refrigerator according to claim 4, wherein the fault condition indicates a need to replace the water filter.

6. The refrigerator according to claim 4, further comprising: a timer that determines a total time the valve is in the open position.

7. The refrigerator according to claim 4, further comprising: a flow meter that determines an amount of water flowing through the valve.

8. A refrigerator comprising:

a cabinet shell;

a liner arranged within the cabinet shell and defining a refrigerated compartment;

a door pivotally mounted relative to the cabinet shell for selectively closing the refrigerated compartment; and a water product dispensing system including:

a water delivery system including a valve that controls a flow of water in the refrigerator;

a dispenser mounted in the door for selectively releasing a water product;

a display provided on the dispenser, wherein the display includes an alarm screen; and a sensor operatively coupled to the dispenser and the water delivery system, said sensor determining a fault condition and presenting the fault condition on the display upon sensing demand for a water product, wherein the fault condition is displayed only during a period of time when a consumer activating the water delivery system is likely to view the fault condition on the display, said fault condition being presented on the alarm screen, wherein the alarm screen remains active upon the display for the period of time which includes some predetermined period following completion of a dispensing operation.

9. A water product dispensing system comprising:

a water delivery system including a valve that controls a flow of water;

a dispenser for selectively releasing a water product;

a display provided on the dispenser, wherein the display includes an alarm screen; and a sensor operatively coupled to the dispenser and the water delivery system, said sensor determining a fault condition and presenting the fault condition on the display upon sensing demand for a water product, wherein the fault condition is displayed only during a period of time when a consumer activating the water delivery system is likely to view the fault condition on the display, said fault condition being presented on the alarm screen, wherein the alarm screen remains active upon the display for the period of time which includes some predetermined period following completion of a dispensing operation.

10. The water product dispensing system according to claim 9, wherein the display is constituted by an LCD display provided with a backlight, said backlight being automatically activated upon operation of the water product dispensing system.

11. The water product dispensing system according to claim 9, further comprising: a timer that determines a total time the valve is in the open position.

12. The water product dispensing system according to claim 9, further comprising: a flow meter that determines an amount of water flowing through the valve.

13. The water product dispensing system according to claim 9, wherein the alarm screen flashes the fault condition.

14. The water product dispensing system according to claim 9, wherein the fault condition is presented in an alpha format.

15. The water product dispensing system according to claim 9, wherein the water delivery system includes a water filter operatively connected to the valve, said fault condition being associated with water flowing through the water filter.

16. The water product dispensing system according to claim 15, wherein the fault condition indicates a need to replace the water filter.

17. A method of signaling a fault condition associated with a water product dispensing system comprising:

sensing a fault condition associated with the water product dispensing system;

activating a water delivery system to direct a water product to a dispenser;

signaling a presence of the fault condition on a display associated with the dispenser upon sensing demand for a water product, such that the fault condition is displayed only during a period of time when a consumer activating the water delivery system is likely to view the fault condition on the display; and presenting the fault condition on an alarm screen portion of the display for the period of time which includes some predetermined period following de-activation of the water delivery system.

18. The method of claim 17, wherein the fault condition represents a need to replace a water filter in the water product dispensing system.

19. A method of signaling a fault condition associated with a water product dispensing system comprising:

sensing a fault condition associated with the water product dispensing system;

activating a water delivery system to direct a water product to a dispenser;

signaling a presence of the fault condition on a display associated with the dispenser upon sensing demand for a water product, such that the fault condition is displayed only during a period of time when a consumer activating the water delivery system is likely to view the fault condition on the display; and presenting the fault condition on an alarm screen portion of the display by flashing the fault condition on the alarm screen.

* * * * *